US005110154A

United States Patent [19]

Street

[11] Patent Number: 5,110,154

[45] Date of Patent: May 5, 1992

[54] COMBINATION SKI POLE AND GLOVE

[76] Inventor: Glenn M. Street, 1806 Danielle Dr., St. Cloud, Minn. 56301

[21] Appl. No.: 719,358

[22] Filed: Jun. 24, 1991

Related U.S. Application Data

[63] Continuation-in-part of Ser. No. 566,080, Aug. 13, 1990, abandoned.

[51] Int. Cl.[5] ..... A63C 11/00; A63C 11/22

[52] U.S. Cl. ..... 280/822; 280/816; 2/160; 2/161 A; 135/72; 294/25

[58] Field of Search ..... 280/816, 819, 821, 822; 2/160, 161 A; 294/25; 135/65, 72, 76

[56] References Cited

U.S. PATENT DOCUMENTS

| | | | |
|---|---|---|---|
| 461,744 | 10/1891 | Fanshawe | 2/160 |
| 1,173,971 | 2/1916 | Hunter | 2/160 X |
| 1,836,223 | 12/1931 | Burns et al. | 294/25 |
| 3,163,436 | 12/1964 | Shride et al. | 280/822 |
| 3,170,703 | 2/1965 | Marchand | 280/822 |
| 3,218,089 | 11/1965 | Marchand | 280/822 |
| 3,232,632 | 2/1966 | Lewis | 280/822 |
| 3,368,811 | 2/1968 | Finney | 280/821 X |
| 3,438,630 | 4/1969 | Petti | 294/25 X |
| 3,540,751 | 11/1970 | Pierce | 280/822 |
| 3,995,872 | 12/1976 | Joseph | 280/822 |
| 4,159,116 | 6/1979 | Geist | 2/161 A X |
| 4,315,641 | 2/1982 | Larsen | 280/822 |
| 4,435,008 | 3/1984 | Black | 294/25 |
| 4,653,121 | 3/1987 | Kassal et al. | 280/822 X |
| 4,698,851 | 10/1987 | Dunford et al. | 2/161 A X |
| 4,728,123 | 3/1988 | Kassal et al. | 280/822 |
| 4,775,168 | 10/1988 | Dalebout | 280/821 |
| 4,779,896 | 10/1988 | Ingalls | 280/821 |
| 4,793,005 | 12/1988 | Hetzel, Jr. | 2/161 A |
| 4,938,487 | 7/1990 | Ponsart | 2/160 X |
| 5,004,231 | 4/1991 | Alread | 2/161 A X |
| 5,018,221 | 5/1991 | Romandetto | 2/161 A X |

FOREIGN PATENT DOCUMENTS

| | | | |
|---|---|---|---|
| 2656814 | 6/1978 | Fed. Rep. of Germany | 280/822 |
| 2378534 | 9/1978 | France | 280/822 |
| 2593034 | 7/1987 | France | 2/161 A |
| 2594702 | 8/1987 | France | 280/822 |
| 2630342 | 10/1989 | France | 280/821 |
| 195360 | 1/1930 | Switzerland | 280/822 |

*Primary Examiner*—Andres Kashnikow
*Assistant Examiner*—Brian L. Johnson
*Attorney, Agent, or Firm*—Haugen and Nikolai

[57] ABSTRACT

A ski glove having a strap extending diagonally across the palm and between a thumb-receiving pocket and an index finger-receiving pocket is fastened to the rear of the glove and includes a clip thereon for engaging a mating latch mechanism formed on the hand-grip of a ski pole such that the skier may more rapidly engage and disengage his hand from the ski pole than can be accomplished when conventional ski pole straps are employed. The quick-connected/disconnect feature is important in certain competitions where skiing and another activity, e.g., rifle shooting, are involved. Discussed are several connected/disconnect devices.

13 Claims, 5 Drawing Sheets

Fig.-3
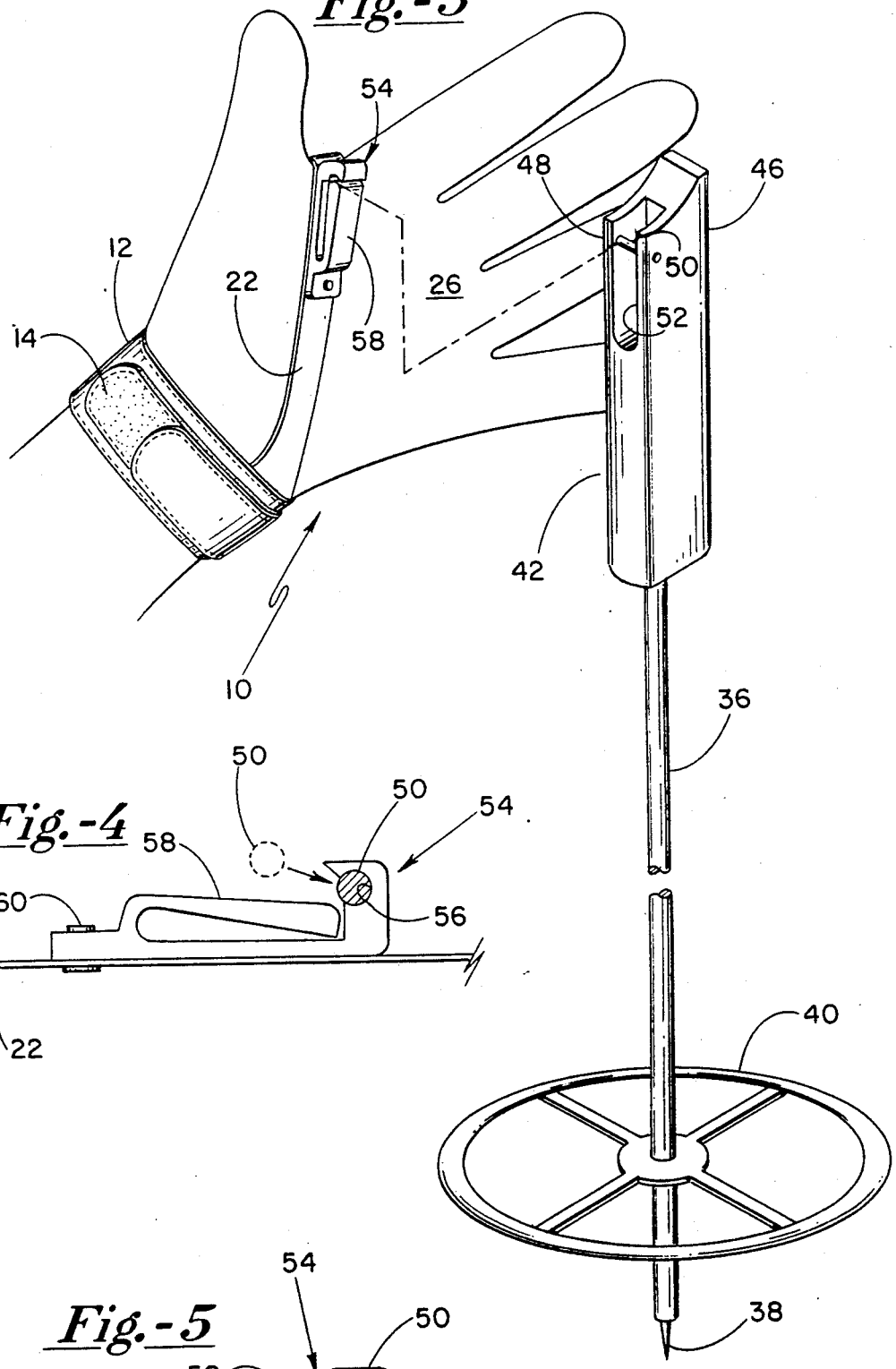
Fig.-4
Fig.-5
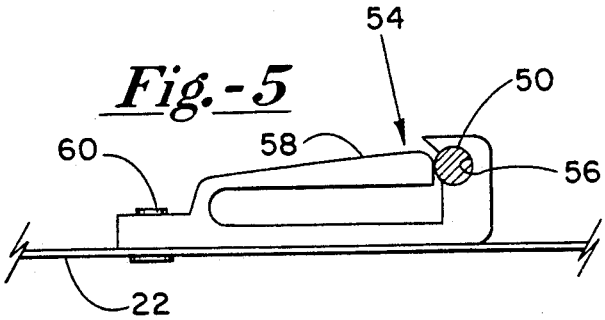

COMBINATION SKI POLE AND GLOVE

CROSS-REFERENCE TO RELATED APPLICATION

This is a continuation-in-part of application Ser. No. 07/566,080 filed Aug. 13, 1990, abandoned.

BACKGROUND OF THE INVENTION

I. Field of the Invention

This invention relates generally to skiing equipment, and more particularly to a combination of a ski glove and ski pole whereby the skier can rapidly either couple or uncouple his ski glove from the ski poles.

II. Discussion of the Prior Art

In certain skiing competitions, it is imperative that the s be able to rapidly release and reattach his hands to the ski poles. Specifically, in Olympic biathlon competition, the skier traverses a cross country path and periodically must stop, take a rifle from the shoulder, fire at targets and then move on to a next station. In such competition, seconds are important.

Conventional ski poles generally comprise an elongated pole having a ground-engaging tip at one end, a basket-like extension a short predetermined distance above the ground-engaging tip and a hand grip at the opposite end. Associated with the hand grip are loop-type straps through which the skier inserts his hand so that the strap effectively wraps around the wrist as the skier grasps the hand grip and poles his way along the path of travel. With such conventional ski poles, valuable time may be lost when it becomes necessary to remove the wrist straps from the skier's wrists so that he may, in turn, grasp his rifle and begin firing. Similarly, when the shooting phase at a particular station has been completed, the skier must again manipulate his hand and wrist through the straps of the ski pole before taking off down the trail. It is also found that conventional wrist straps tend to concentrate the poling forces at two major points on the hand causing discomfort and sometimes injury. Moreover, the strap also frequently crawls up the hand and it must be repositioned around the wrist. This causes the skier to momentarily interrupt his skiing technique and, thereby, decrease skiing velocity.

OBJECTS

It is the principal purpose of the present invention to provide a ski pole grip and ski glove combination which allows rapid coupling and uncoupling of the skier's gloved hand to and from the hand grip of a ski pole.

Another object of the invention is to incorporate with a ski glove a strap arrangement which may be rapidly joined to or removed from the hand grip of a ski pole where the strap continues to provide support and comfort during the skiing phase of the competition. Time trials have established that the use of the present invention has allowed up to six seconds of time to be saved in coupling and uncoupling a skier from his ski poles as compared to conventional ski pole strap arrangements.

SUMMARY OF THE INVENTION

The foregoing features and advantages of the present invention are achieved by providing a ski pole having a ground-engaging tip at one end and a hand grip adjacent the other end where the hand grip includes a forward surface area and a rear surface area on the opposed side of the hand grip. A first half of a latch member is affixed to the hand grip of the ski pole at a location on the rear surface area thereof. Used with the pole of the present invention is a ski glove having an adjustable wrist band and a narrow strap fastened at one end to the wrist band on the palm side of the glove or simply looped over the glove and traversing the palm of the glove at a predetermined angle so as to pass between a thumb-receiving pocket and an index finger-receiving pocket of the glove to fasten releasably at its other end on the back side of the glove. An appropriate device for cooperating with the first half of the latch member on the hand grip of the pole is attached to the strap so as to face away from the palm of the glove at a location near the junction of the thumb-receiving pocket and the index finger-receiving pocket. In accordance with a first arrangement, the latch member comprises a rigid pin which is recessed in the hand grip and the means attached to the strap crossing the palm of the ski glove is a hook which is insertable into the recess for engaging the pin. In accordance with a second embodiment, latch member which is affixed to the hand grip of the ski pole includes a transversely extending slot formed in the hand grip member and the means attached to the strap comprises a mating device releasably insertable into the slot. Specifically, the latch member may comprise a spring pawl mounted in the hand grip with an edge of the pawl intersecting the slot. The means attached to the strap comprises a ratchet surface insertable into the slot and engageable by the pawl.

In still a further embodiment, the transversely extending slot formed in the handle member of the ski pole may have a generally circular cross-section and be configured so as to extend through one side surface of the hand grip at a location between the forward surface area and the rear surface area thereof. Then, the means attached to the strap includes a protuberance of a generally circular cross-section dimensioned so as to slidingly fit into the transversely extending slot from the side.

A further alternative for releasably coupling the hand grip of the ski pole to the user's ski glove comprises a D-shaped ring which extends outward from the hand grip and, then, there is attached to the strap crossing the palm of the ski glove a hook for engaging the ring.

Yet another arrangement involves a recess formed into the rear surface of the hand grip where the recess includes a slot formed in a bottom wall thereof. Fitted into the handle grip portion of the ski pole is a spring-loaded arm which is pivotally mounted within the recess and selectively displaceable from a covering relation relative to the slot formed in the bottom of the recess to a position wherein the slot is uncovered. Then, affixed to the strap traversing the palm of the ski glove is a ring which is insertable into the recess and into the slot formed in the bottom wall. The ring is captured and prevented from exiting the slot formed in the bottom wall when the spring-loaded arm is in its covering relation relative to the slot.

Yet another arrangement includes a longitudinal slit formed in the strap traversing the palm of the ski glove, wherein a loop is formed by attaching one end of a loop material to the strap on one side of the slit, and attaching the other end of the loop material to the strap on the other side of the slit. An elastic segment is attached across the slit nearly proximate the loop to bias the slit together. A tapered end of the hand grip having a narrowed region is insertable into the loop wherein the loop securably engages the narrowed region.

Any of the foregoing arrangements allows the skier to rapidly couple the pole to his hand by appropriately manipulating the latch arrangement on the hand grip portion of the ski pole with a mating member disposed on an elongated strap which is arranged to traverse across the palm of the wearer's hand from a location near the pisiform bone and between the thumb-receiving pocket and the index finger-receiving pocket of the glove. Because of the carefully designed strap system sewn into the glove, the poling forces are more evenly distributed over the hand, thereby providing increased comfort to the hand and improved blood circulation for keeping the hands warm.

Further features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE DRAWINGS

FIG. 3 shows the manner in which the embodiment of FIG. 1 releasably couples the ski glove to a ski pole;

FIG. 4 is a side elevation of the strap and spring catch when coupled to the latch pin when the spring element is depressed;

FIG. 5 is a side elevation of the strap and spring catch when coupled to the latch pin with the spring element released;

DESCRIPTION OF THE PREFERRED EMBODIMENT

Figure 1:
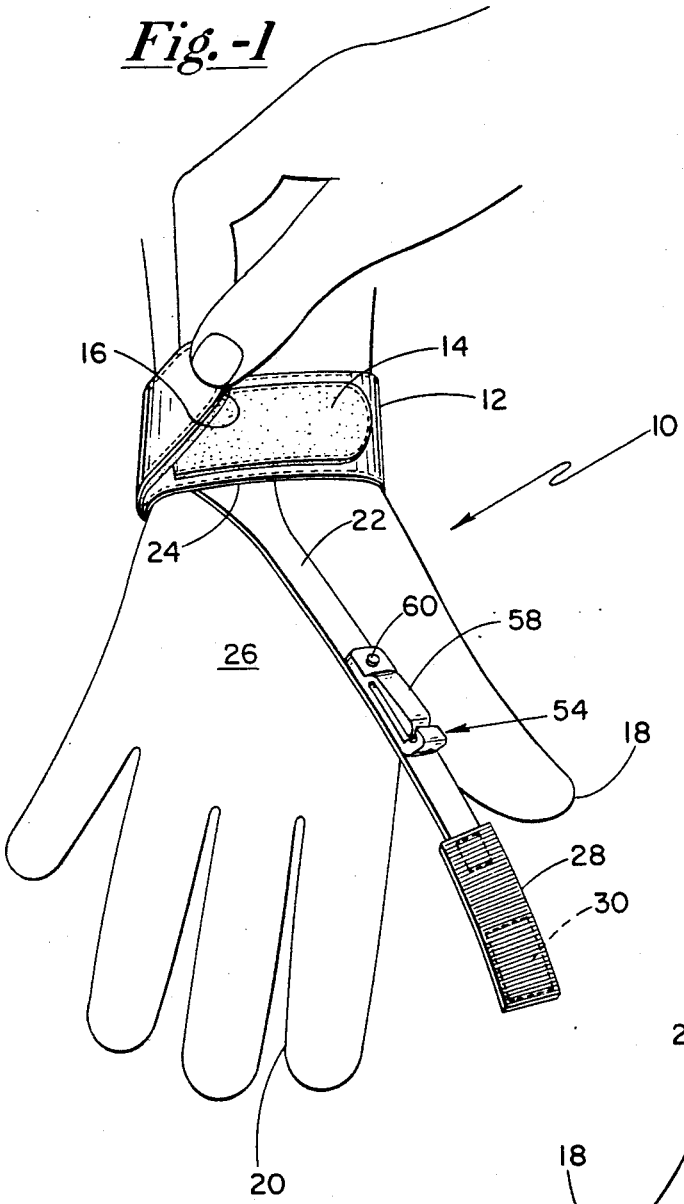
FIG. 1 is a view of a ski glove in accordance with one embodiment of the present invention when looking at the palm surface thereof.

Referring first to FIG. 1, there is indicated generally by numeral 10 a ski glove as observed from the palm side of the hand. It is seen to include a wrist band 12 having a VELCRO® releasable fastener affixed thereto. Specifically, the hook portion of the VELCRO fastener is identified by numeral 14 and formed on a mating surface of the wrist band 12 is the loop-type fabric 16. In this fashion, the glove can be snugged against the wrist of the wearer to a desired degree of tension.

Figure 2:
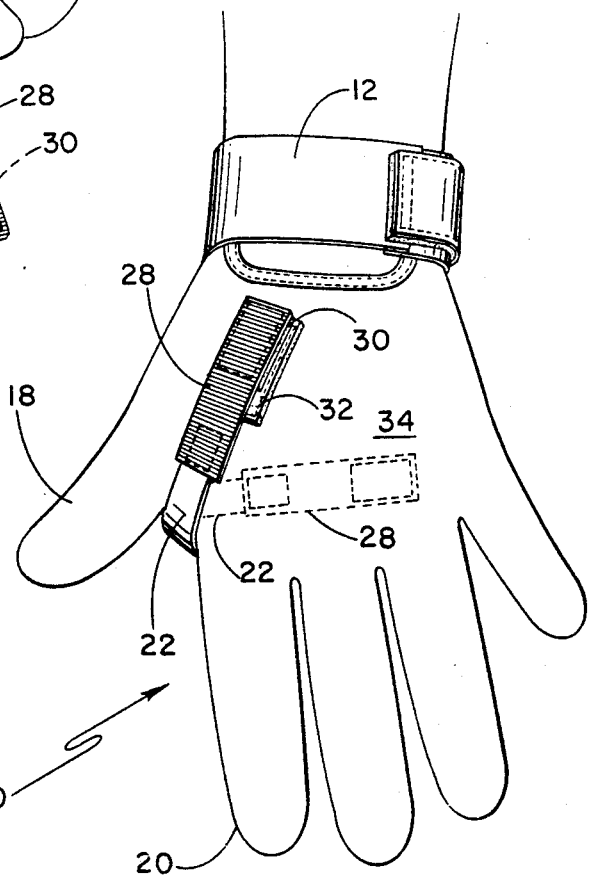
FIG. 2 is a view of the ski glove of FIG. 1 when looking at the back of the wearer's hand.

As is conventional, the glove includes five finger receiving pockets including a thumb-receiving pocket 18 and an index finger-receiving pocket 20. A strap 22 which may be formed from leather or NYLON® webbing is sewn at a first end 24 to the wrist band 12 near the location of the pisiform bone in the hand and is routed at a predetermined angle across the palm 26 of the glove to then pass between the thumb-receiving pocket 18 and the index finger receiving pocket 20. The free end of the strap 22 may have a short segment of elastic fabric 28 sewn to it and, the side of the elastic segment 28 facing away from the observer in FIG. 1 also has a VELCRO segment sewn to it, as identified by numeral 30. Referring to FIG. 2, it can be seen that the VELCRO segment 30 is arranged to mate with a corresponding segment 32 sewn to the back of the glove 34 at a location which allows the attachment to be made without twisting the strap 22 in any way. By providing a VELCRO fastener 30-32, the amount of tension exerted by the strap 22 across the palm of the hand can be adjusted.

Referring again to FIG. 1, there is attached to the strap 22 at a location on the palm side of the strap near the intersection of the thumb-receiving pocket 18 and the index finger-receiving pocket 20 a means for engaging a latch member on a ski pole, all as will be more particularly described below.

In accordance with a first embodiment and, with reference to FIG. 3, the ski pole in question comprises an elongated tubular or solid shaft 36 having a ground-engaging end 38, a basket-like extension 40 located near the ground-engaging end 38 and secured to the pole 36. Attached to the opposite end of the pole 36 is a hand grip member 42 having a forward facing surface area 46. The term "forward" is in reference to the direction the grip is pointing when being grasped by the skier when in use. Formed on the rear facing surface area 48, which is at a location about 180° opposite the forward facing surface area 46 is a latch pin 50 in the form of a transversely extending pin. Latch pin 50 fits into a recess 52 formed inward of the rear surface area 48 of the ski pole handle member 42.

In FIGS. 1 through 5, the means attached to the strap 22 for engaging the latch pin 50 comprises a hook 54 which may be formed from metal or plastic and which includes a semi-circular recess 56 for receiving the latch pin 50 affixed to the hand grip 42. Forming a part of the hook 54 is a spring-type leaf detent 58 which, as is shown in FIGS. 4 and 5, can be depressed to allow the latch pin 50 to slip into the recess 56 in the hook. When released, it springs up to block the latch pin 50 from sliding out of its semi-circular recess. The latch pin 50 may be secured to the strap 22 by any suitable means, such as rivet 60.

In use, when the skier wishes to engage the hook 54 on the strap 22 to the ski pole, he merely grasps the hand grip 42 of the ski pole in such a fashion that the hook 54 fits within the recess 52. The pressure of the latch pin 50 against the leaf detent 58 causes it to depress to the point where the latch pin 50 can slip into the semi-circular recess 56 formed in the inside surface of the hook. Once so seated, the leaf detent 58 can move to the position shown in FIG. 5 to thereby block the latch pin 50 from coming free from the hook.

When it is desired to uncouple the ski pole from the hook, the user merely inserts the thumb of his opposite hand against the leaf detent 58 while pulling down on the hand grip 42. This combination of resulting forces causes the leaf detent 58 to be depressed to the position shown in FIG. 4 allowing the hook to be released from its latch pin 50.

Figure 6:
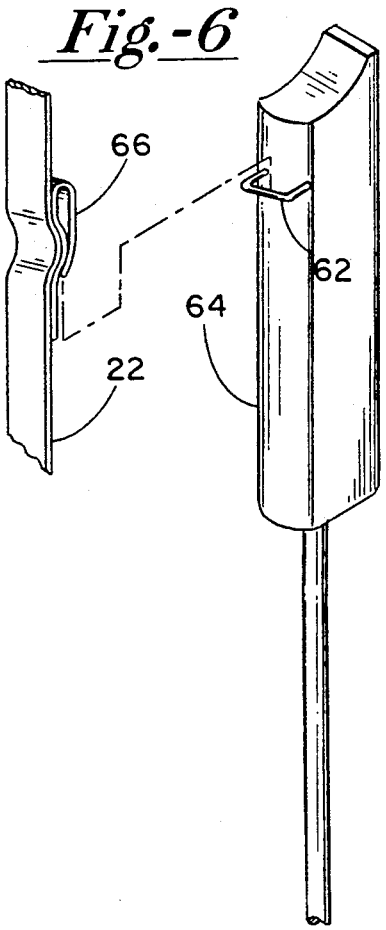
FIG. 6 shows yet another alternative embodiment for releasably coupling the ski glove to a ski pole.

Referring now to FIG. 6, there is shown an alternative arrangement wherein a D-shaped ring or bail 62 is attached to the rear surface area 64 of the ski pole handle, i.e., the side which is 180° away from the forward facing surface area 46. Affixed to the strap 22 is a bent metal or plastic hook 66 having a mouth which is downwardly oriented when the strap 22 is dropped across the glove in the fashion illustrated in FIGS. 1 and 2 of the drawings. By merely slipping the hook 66 over the outwardly projecting D-shaped ring 62, the ski pole becomes latched to the glove of the wearer.

Figure 7:
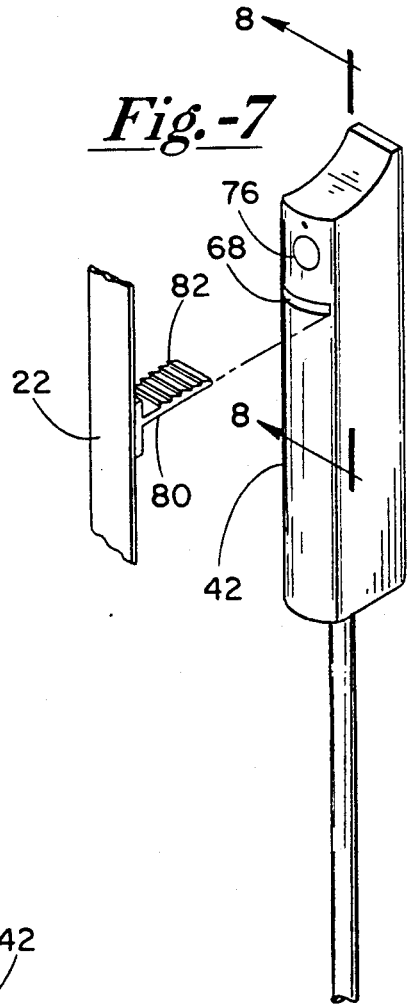
FIG. 7 is still another embodiment for releasably coupling the ski glove to a ski pole.
Figure 8:
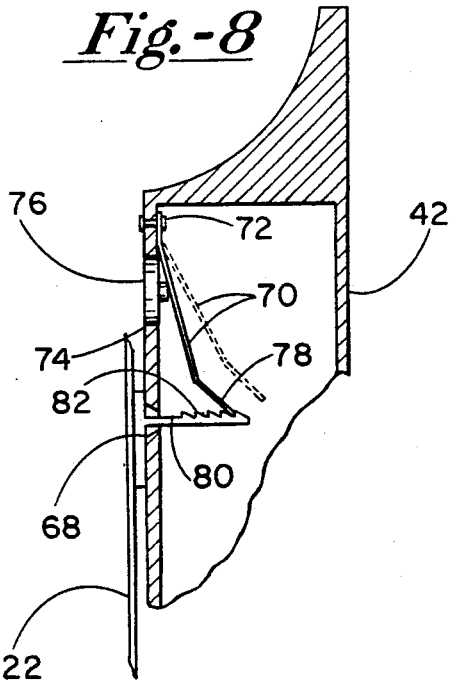
FIG. 8 is a detailed assembled cross-sectional view of section 8—8 of a ski pole hand grip of the embodiment of FIG. 7.

In the arrangement shown in FIGS. 7 and 8, the hand grip 42 includes a slot-like recess 68 and internal of the hand grip 42 is a flat leaf spring member 70 which functions as a pawl. The leaf spring 70 is affixed to the handle by a suitable fastener 72 at its upper end and then extends past a circular opening 74 in which is fitted a push button 76. The other end of the leaf spring 70 intersects with the slot 68, as at 78, and thus normally extends into the slot 68. Depression of the push button 76, however, deflects the leaf spring 70 such that its free end 78 is no longer within the confines of the slot 68.

Adapted to mate with the latch mechanism is a flat blade-like member 80 having a saw tooth pattern of notches 82 formed on the upper surface thereof. The toothed plastic flat member 80 is appropriately secured to the strap 22 so as to project generally perpendicularly from the palm of the hand of the wearer. The flat member 80, when pushed into the slot or recess 68 in the hand grip 42 of the ski pole, becomes engaged with the leaf spring 70 because the tip end 78 thereof falls into one of the series of notches 82. When so inserted, the ski pole handle is latched to the ski glove assembly. By depressing the push button 76 and thereby lifting the end 78 of the leaf spring out of the slot 68, it no longer engages the teeth 82 allowing the pole to be pulled free of the strap on the glove.

Figure 9:
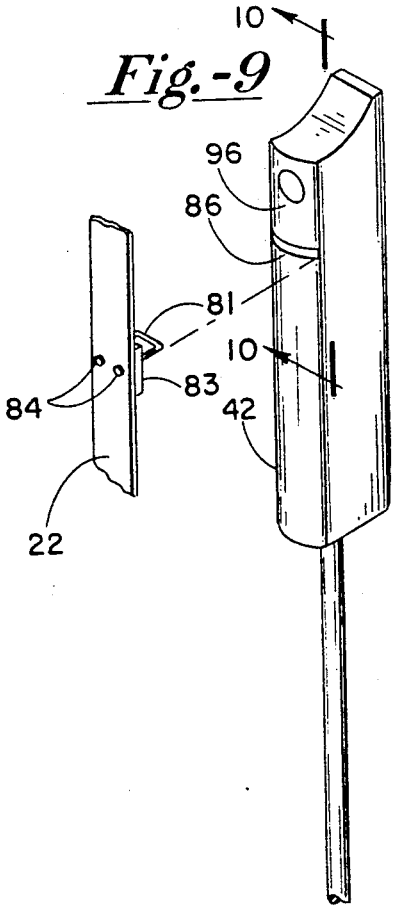
FIG. 9 is a further embodiment of the invention.
Figure 10:
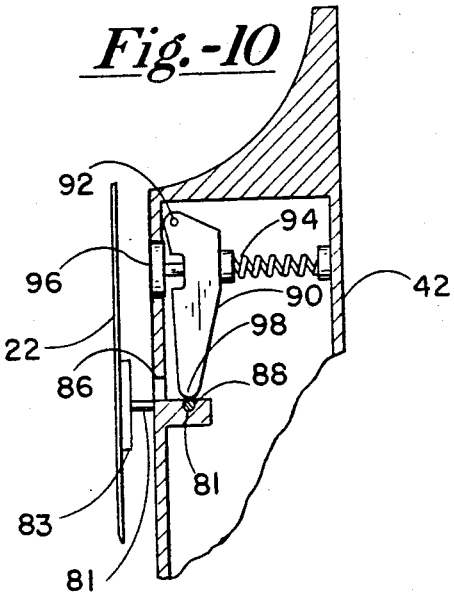
FIG. 10 is a detailed assembled cross-sectional view of section 10—10 of a ski pole hand grip of the embodiment of FIG. 9.

FIGS. 9 and 10 show yet another alternative embodiment of the invention. Here, the strap 22 has a D-shaped ring 81 affixed to it. The ring may be integrally formed with a backing member 83 and fasteners 84 pass through it to secure the D-shaped ring assembly to the strap 22 which, as in the embodiment of FIGS. 1 through 3, traverses the palm of the wearer's glove. The D-shaped ring 81 is arranged to fit into a slot-like recess 86 which extends into the rear surface of the hand grip 42. With reference to FIG. 10, it can be seen that a D-shaped slot 88 is formed downward into the body of the hand grip 42 in the bottom wall of the recess 86. Extending over the D-shaped slot 88 is a spring loaded arm 90 which is pivoted for limited rotation about a pivot point 92 and normally biased rearward by the action of a spring 94. A push button 96 fits into an aperture formed through the wall of the hand grip 42 and operatively engages the pivot arm 90 as illustrated. By depressing the push button 96, the arm can be swung inward against the force provided by the bias spring 94 until the lower end 98 of that arm no longer subtends the D-shaped slot 88.

In use, then, the skier by merely gripping the hand grip 42 in his gloved hand will cause the D-shaped ring 81 to enter the slot 86, pushing the pivot arm 90 inward until the D-shaped ring 81 slips into the D-shaped notch 88. At this point, the force of the spring 94 swings the pivot arm 90 again in a covering relationship relative to the D-shaped notch 88 containing the D-shaped ring 81.

Figure 11:
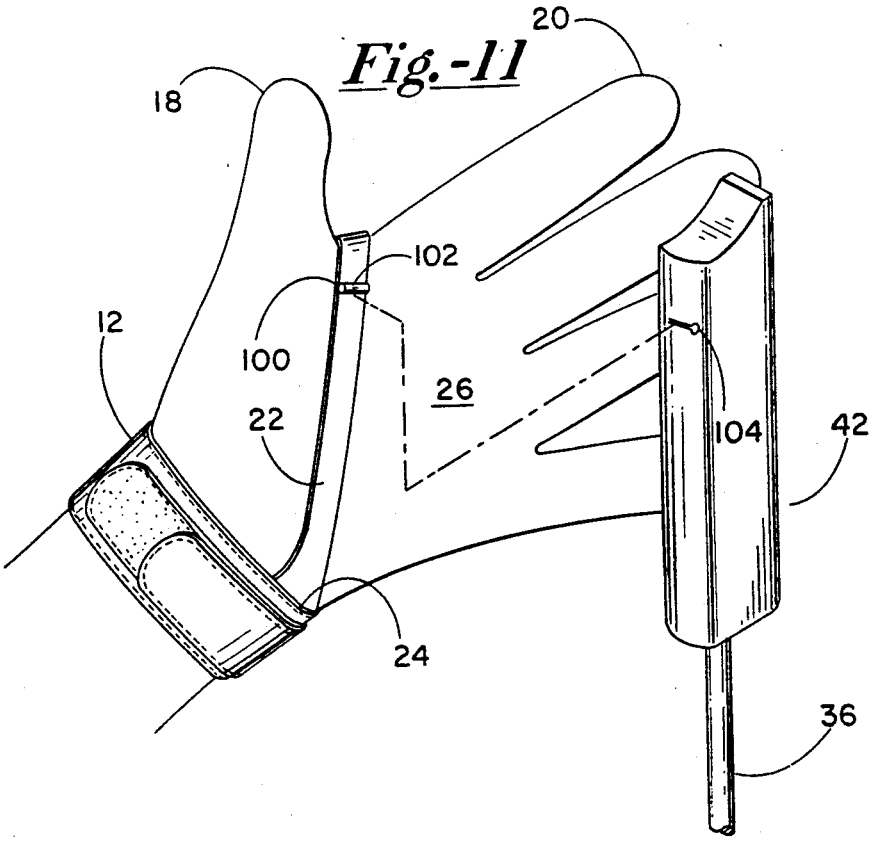
FIG. 11 is yet another embodiment of the invention.

FIG. 11 illustrates yet another embodiment of the invention whereby a skier can rapidly engage and disengage his gloved hand to the hand grip of a ski pole. In this manner, the skier may put on a special glove, quickly attach to the pole, ski and then detach quickly from the pole. Here, the glove 10 also includes a diagonally extending strap 22 traversing the palm 26 of the hand and extending between the thumb-receiving pocket 18 and the index finger-receiving pocket 20 to fasten to the back of the glove as shown in FIG. 2. The strap 22 is bunched at 100 to form a generally cylindrical roll 102 by suitable stitching not shown. The roll projects outward from the exposed surface of the strap 22.

With the arrangement shown in FIG. 11, the hand grip 42 of the ski pole is provided with a circular slot 104 formed in the surface thereof. The slot or bore 104 is formed so as to be slightly closer to the rear surface than the radius of the slot 104 and, as such, has a narrow slit through the rear surface of the handle leading to the bore 104. As is represented by the dotted line in FIG. 11, the cylindrical protuberance 102 formed on the strap 22 is arranged to fit within the bore 104 formed in the ski pole hand grip 42 in a side entry fashion. The diameter of the protuberance 102 is larger than the slit-like opening in the rear of the handle so that the roll 102 will be retained within the bore 104 while the skier is skiing. By merely sliding the gloved hand sideways relative to the pole hand grip 42, the roll 102 can be easily disengaged from the bore 104.

Figure 12:
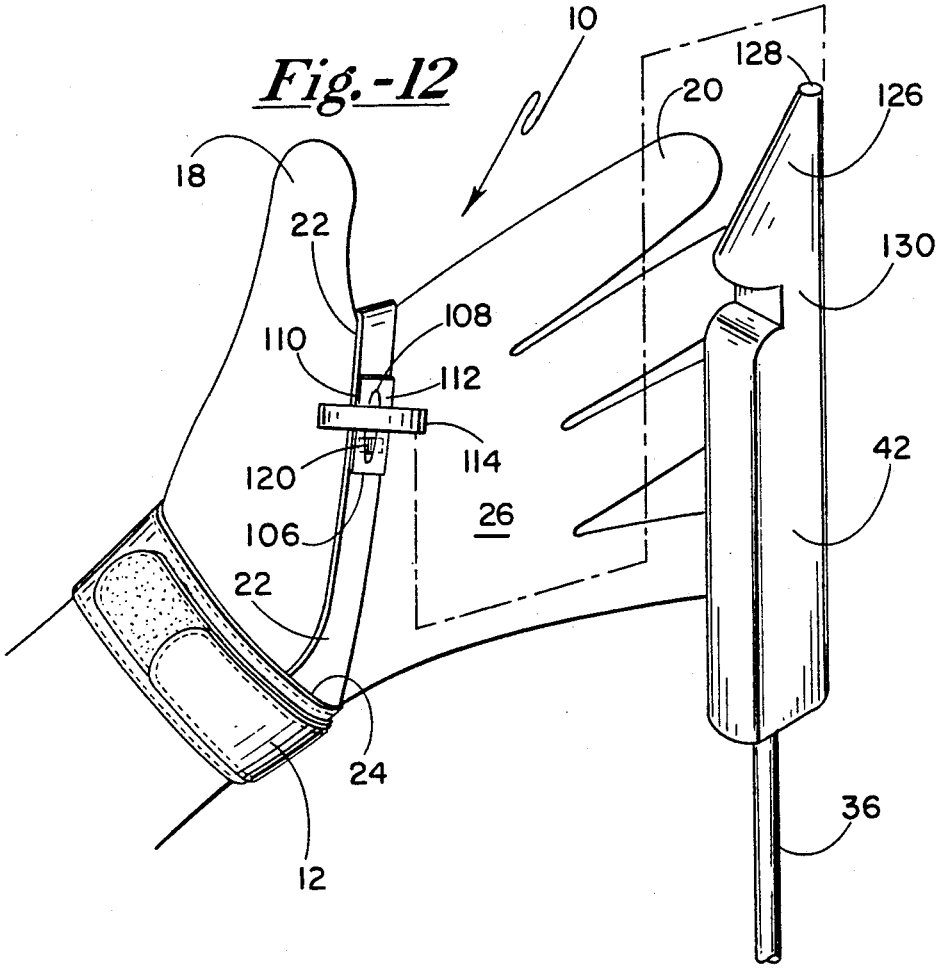
FIG. 12 is yet another embodiment of the invention.

FIG. 12 illustrates yet another embodiment of the invention whereby a skier can rapidly engage and disengage his gloved hand to the grip of a ski pole. Here, glove 10 also includes a diagonally extending strap 22 traversing the palm 26 of the hand and extending between the thumb-receiving pocket 18 and the index finger-receiving pocked 20 to fasten to the back of the glove as shown in FIG. 2. The strap 22 includes a substantially inelastic segment 106, such as NYLON webbing, at a location on the palm side of the strap 22 near the intersection of the thumb-receiving pocket 18 and the index finger-receiving pocket 20. Longitudinal slot 108 is disposed in segment 106 to form a first side 110 and second side 112.

Figure 13:
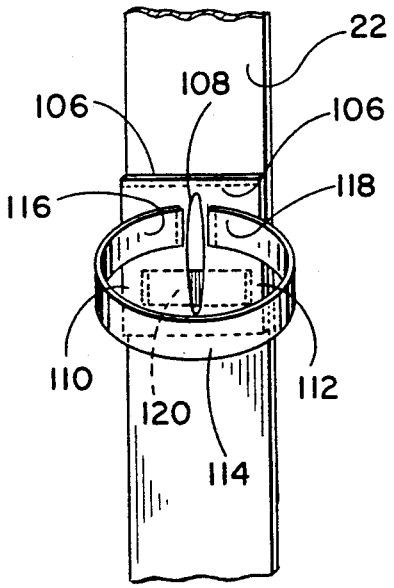
FIG. 13 is an enlarged view of the segment of the embodiment shown of FIG. 12.

Referring now to FIG. 13, loop 114 comprising a substantially inelastic material such as NYLON is formed projecting outward from the exposed surface of strap 22 by attaching a first end 116 to first side 110 and a second end 118 to second side 112, such as by stitching.

Figure 14:
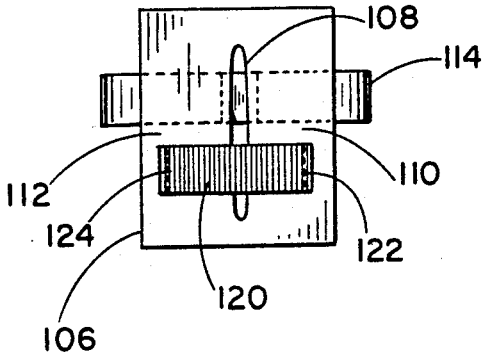
FIG. 14 is a view of the back side of the strap showing the elastic means.

Referring now to FIG. 14, a substantially elastic portion 120 is attached, such as by sewing, to an unexposed side of strap 22 adjacent an area of slot 108 where loop 114 is formed. First end 122 of portion 120 is sewn to first side 110 of segment 106, portion 120 extending across slot 108 to second end 124 which is sewn to the second side 112 of segment 106.

With the arrangement shown in FIGS. 12–14, where like reference numbers represent like items, the hand grip 42 of the ski pole has an end portion 126 tapering toward point 128 and forming a generally conical shape. Narrowed portion 130, formed by a generally V-shaped or rectangular-shaped notch/recess, for example, is disposed nearly proximate point 128. As represented by the dotted line in FIG. 12, point 128 of hand grip 42 is arranged to be insertable in loop 114 such that loop 114 slides over the end portion 126 such that elastic portion 120 stretches, and loop 114 fits snugly into the notch defining narrowed region 130. This arrangement securely and comfortably fastens hand grip 42 to loop 114 while the skier is skiing.

To remove the hand grip 42 quickly from loop 114, hand grip 42 is rotated about 180° while removing it from loop 114. Elastic portion 120 stretches across slot 108 slightly to loosen loop 114 such that loop 114 can slide back over tapered end portion 126. Loop 114 and segment 106 can endure repeated connect and disconnect motions since they are substantially inelastic and will not wear quickly.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In combination, (a) a ski pole having a ground-engaging member at one end and a hand grip adjacent the other end, said hand grip including a forward surface area;

(b) a rigid pin disposed in a recess in said hand grip at a rear surface area at a location generally 180° opposite said forward surface area;

(c) a ski glove having a wrist band and a strap fastened at one end to said wrist band on a palm side of said glove, said strap traversing the palm of said glove at a predetermined angle to pass between a thumb-receiving pocket of said glove and an index finger-receiving pocket of said glove to fasten at the other end on a back side of said glove; and (d) a hook attached to said strap and insertable into the recess for engaging said pin and facing outward from the palm side of said strap proximate the juncture of said thumb-receiving pocket and said index finger-receiving pocket for releasably engaging said pin on said hand grip.

2. The combination as in claim 1 wherein said hook includes a flat spring retainer for holding said hook in engagement with said pin.

3. In combination, (a) a ski pole having a ground-engaging member at one end and a hand grip adjacent the other end, said hand grip including a forward surface area;

(b) a transversely extending slot formed in said hand grip at a rear surface area at a location generally 180° opposite said forward surface area;

(c) a ski glove having a wrist band and a strap fastened at one end to said wrist band on a palm side of said glove, said strap traversing the palm of said glove at a predetermined angle to pass between a thumb-receiving pocket of said glove and an index finger-receiving pocket of said glove to fasten at the other end on a back side of said glove; and (d) a fastening member attached to said strap and releasably insertable in said slot and facing outward from the palm side of said strap proximate the juncture of said thumb-receiving pocket and said index finger-receiving pocket.

4. The combination as in claim 3 further including a spring pawl mounted in said hand grip with an edge end intersecting said slot and said fastening member is a ratchet releasably engageable by said pawl.

5. The combination as in claim 3 wherein said transversely extending slot has a generally circular cross section and extends through one side surface of said hand grip located between said forward surface area and said rear surface area; and said fastening member includes a protuberance of a generally circular cross-section dimensioned to slide laterally into said transversely extending slot.

6. In combination, (a) a ski pole having a ground-engaging member at one end and a hand grip adjacent the other end, said hand grip including a forward surface area;

(b) a D-shaped ring extending outward from said hand grip at a rear surface area at a location generally 180° opposite said forward surface area;

(c) a ski glove having a wrist band and a strap fastened at one end to said wrist band on a palm side of said glove, said strap traversing the palm of said glove at a predetermined angle to pass between a thumb-receiving pocket of said glove and an index finger-receiving pocket of said glove to fasten at the other end on a back side of said glove; and (d) a hook means attached to said strap for engaging said ring and facing outward from the palm side of said strap proximate the juncture of said thumb-receiving pocket and said index finger-receiving pocket for releasably engaging said ring on said hand grip.

7. In combination, (a) a ski pole having a ground-engaging member at one end and a hand grip adjacent the other end, said hand grip including a forward surface area;

(b) a recess formed into said hand grip at a rear surface area at a location generally 180° opposite said forward surface area, said recess including a slot formed in a bottom wall thereof; a spring loaded arm pivotally mounted within said recess and selectively displaceable from a covering relation relative to said slot to a position wherein said slot is open;

(c) a ski glove having a wrist band and a strap fastened at one end to said wrist band on a palm side of said glove, said strap traversing the palm of said glove at a predetermined angle to pass between a thumb-receiving pocket of said glove and an index finger-receiving pocket of said glove to fasten at the other end on a back side of said glove; and (d) a ring attached to said strap and insertable into said recess and into said slot formed in said bottom wall, said ring facing outward from the palm side of said strap proximate the juncture of said thumb-receiving pocket and said index finger-receiving pocket, said ring being captured in said slot when said spring loaded arm is in said covering relation relative to said slot, but removable when said arm is in the open position.

8. In combination, (a) a ski pole having a ground-engaging member at a first end, said ski pole extending to a hand grip at a second end, said hand grip tapering toward said second end and having a recessed region disposed nearly proximate said second end;

(b) a ski glove having a wrist band and a strap fastened at one end to said wrist band on a palm side of said glove, said strap traversing said palm side at a predetermined angle to pass between a thumb-receiving pocket of said glove and an index finger-receiving pocket of said glove to fasten at the other end on a back side of said glove, said strap including a generally longitudinal slit disposed at said palm side of said glove, said slit defining a first strap side and a second strap side;

(c) loop means for defining a loop attached to said strap and facing outward from said palm side of said strap, said loop means having one end fastened to said first strap side and extending across said slit to the other end and fastened to said second strap side, said loop means securingly engaging said recessed region of said ski pole when said second end of said ski pole is inserted into said loop means; and (d) means for retention comprising a substantially elastic material having one end attached to said first strap side of said strap, said means for retention extending across said longitudinal slit and attached at the other end to said second strap side nearly proximate said loop means, said elastic means stretchable upon insertion of said second end of said ski pole into said loop means.

9. The combination as in claim 8 wherein said loop means comprises a substantially inelastic material.

10. The combination of any one of claim 1, 3, 6, 7 or 8 wherein said other end of said strap is releasably fastened to said back side of said glove.

11. The combination as in claim 10 and further including an elastic segment formed in said strap.

12. The combination as in claim 11 wherein said wrist band is adjustable.

13. The combination as in claim 12 wherein said elastic segment is releasably fastened to said back side of said glove with VELCRO hook and loop material.

* * * * *